US010941462B2

(12) United States Patent
Yang et al.

(10) Patent No.: US 10,941,462 B2
(45) Date of Patent: Mar. 9, 2021

(54) QUENCHING HEAT TREATMENT DEVICE AND ON-LINE INTELLIGENT CONTROL METHOD FOR THE COOLING CHARACTERISTICS OF QUENCHING LIQUID

(71) Applicant: Shanghai Yibai Industrial Furnaces Co., Ltd., Shanghai (CN)

(72) Inventors: Jingfeng Yang, Dafeng (CN); Haibin Wang, Zhenjiang (CN)

(73) Assignee: SHANGHAI YIBAI INDUSTRIAL FURNACES CO., LTD., Shanghai (CN)

( * ) Notice: Subject to any disclaimer, the term of this patent is extended or adjusted under 35 U.S.C. 154(b) by 175 days.

(21) Appl. No.: 16/175,300

(22) Filed: Oct. 30, 2018

(65) Prior Publication Data

US 2020/0102626 A1 Apr. 2, 2020

(30) Foreign Application Priority Data

Sep. 29, 2018 (CN) ..... 201811149286.4

(51) Int. Cl.
*C21D 11/00* (2006.01)
*C21D 1/60* (2006.01)
*C21D 1/63* (2006.01)

(52) U.S. Cl.
CPC ..... *C21D 11/005* (2013.01); *C21D 1/60* (2013.01); *C21D 1/63* (2013.01)

(58) Field of Classification Search
CPC ..... C21D 11/005; C21D 1/18; C21D 1/60; C21D 1/63; C21D 1/64; C21D 1/70
USPC ..... 266/46, 120, 131, 130, 112, 107, 259, 266/274; 148/559, 660, 658, 654, 647
See application file for complete search history.

(56) References Cited

U.S. PATENT DOCUMENTS 3,784,416 A * 1/1974 Davies ..... C21D 5/04 148/542
5,837,189 A * 11/1998 Westman ..... C21D 1/60 266/131
6,099,666 A * 8/2000 Powell ..... C21D 1/63 148/500
9,617,611 B2 * 4/2017 Grobler ..... C21D 1/767
10,072,315 B2 * 9/2018 Korecki ..... C21D 1/773

* cited by examiner

*Primary Examiner* — Scott R Kastler
*Assistant Examiner* — Michael Aboagye
(74) *Attorney, Agent, or Firm* — Muncy, Geissler, Olds & Lowe, P.C.

(57) ABSTRACT

An on-line intelligent control method for the cooling characteristics of a quenching liquid in heat treatment production includes the steps of: step 1: subjecting a workpiece to thermal insulation; step 2: measuring the cooling characteristics and the heat transfer coefficient of a quenching liquid followed by correction; step 3: starting cooling; step 4: then changing the internal circulation rate; and step 5: removing the workpiece. This scheme can effectively avoid the problem that the cooling of a workpiece in industrial production deviates from the ideal cooling characteristics of a quenching liquid obtained in a laboratory.

6 Claims, 2 Drawing Sheets

QUENCHING HEAT TREATMENT DEVICE AND ON-LINE INTELLIGENT CONTROL METHOD FOR THE COOLING CHARACTERISTICS OF QUENCHING LIQUID

FIELD OF THE INVENTION

The invention relates to the field of immersion-liquid quench cooling in metal heat treatment production, and in particular to a quenching heat treatment device and an on-line intelligent control method for the cooling characteristics of a quenching liquid.

BACKGROUND OF THE INVENTION

A quenching medium and a cooling method have a significant influence on the quenching stress distribution of a workpiece during quench cooling. Generally, when quenching is carried out using a dilute solution of a water-soluble polymer quenching agent, and a liquid organic polymer is deposited on the metal surface to form a film, thus the cooling degree of the metal can be adjusted by adjusting the thickness of the polymer film.

The thickness of a polymer film is obtained by adjusting the concentration of a polymer quenching agent in a quenching cooling tank. When the concentration of a polymer quenching agent in a solution is less than a certain concentration, precipitation occurs in a high-temperature zone during quenching, which can function to soak the surface of a workpiece to promote faster breakage of a water vapor film. Therefore, the cooling capacity of the polymer is close to that of an aqueous NaCl solution when the concentration is low. When the concentration of the polymer is increased, a deposited film can be formed on the surface of the workpiece during quenching, which functions as a heat insulating layer to reduce the cooling rate. The presence of the deposited film leads to relatively uniform heat dissipation, thereby eliminating soft spots and reducing the internal stress of the workpiece to prevent the workpiece from deformation. The temperature of a polymer quenching liquid is inversely proportional to the cooling rate, and the relative flow rate is proportional to the cooling rate. Therefore, cooling can be controlled by adjusting the concentration, temperature or degree of agitation of the quenching liquid.

The first indicator of a water-soluble quenching medium is to reduce the cooling rate in a low-temperature stage while maintaining or substantially maintaining a rapid cooling rate in a high-temperature stage. The most representative temperature in the low-temperature stage is about 300° C. The cooling rate obtained when a steel article is cooled to about 300° C. is referred to as "the cooling rate at 300° C." of a quenching medium. It is theoretically and experimentally proved that the cooling rate of a quenching medium at about 300° C. plays a decisive role in the quench cracking of most steel workpieces. However, in practical production, the time for a polymer to be rapidly desolventized from a solution so as to form a polymer film on the surface of a workpiece is affected by the number, shape, surface area, heat exchange efficiency and stirring rate of workpieces. If the time is not monitored in real time, it is very difficult to ensure that the cooling rate can be effectively reduced just when a steel article is cooled to about 300° C.

Different steel grades have different critical cooling rates, and some even differ greatly. Therefore, it is impossible for any quenching agent to satisfy the quenching of all steel products at the same time. Due to the limitations of materials and many heat treatment processes, the cooling rate that can be achieved on a laboratory cooling curve in many cases cannot be achieved on an industrial production scale. For example, changes in the number and surface area of workpieces will lead to a change in the temperature rise rate of a quenching medium, thereby affecting the cooling curves of the workpieces in practical production. The efficiency of temperature regulation by a heating and cooling device in a quenching tank is very low, and the temperature cannot be flexibly controlled such that a workpiece cannot obtain a cooling curve measured in a quenching medium laboratory. In production, both removal of workpieces and high-temperature oxidative decomposition will lead to a reduced amount of a polymer in an aqueous polymer quenching medium; and the volatilization of tap water, the accumulation of foreign contaminants, the aging of a quenching agent and the like will affect the cooling characteristics of a quenching liquid such that the cooling characteristics deviate from the cooling characteristics obtained in a laboratory.

SUMMARY OF THE INVENTION

To address the disadvantages existing in the prior art, the invention provides an on-line intelligent control method for the cooling characteristics of a quenching liquid in heat treatment production.

To achieve the above object, the invention employs the following technical solution: a quenching heat treatment device comprises a quenching tank, a sub-tank and a control cabinet.

A heating plate I for heating a quenching agent is arranged at the bottom of the quenching tank; the quenching tank is internally provided with an internal-circulation temperature equalization device; a temperature sensor I for measuring the temperature of the quenching agent and a heat transfer coefficient sensor for measuring the heat transfer coefficient of the quenching agent are arranged at the top of the quenching tank; and a workpiece entrance is arranged at the top of the quenching tank.

A heating plate II for heating the quenching agent is arranged at the bottom of the sub-tank; an external-circulation temperature equalization device for equalizing the temperature of the quenching tank and the sub-tank are arranged between the sub-tank and the quenching tank; a temperature sensor II for measuring the temperature of the quenching agent is arranged at the top of the sub-tank; and a cooling module for cooling the quenching agent is arranged on a side wall of the sub-tank.

The control cabinet is internally provided with a touch screen, an industrial control computer, a PLC controller, a temperature control module and a data acquisition board; the industrial control computer is electrically connected with the touch screen and the PLC controller respectively via USB data lines; the PLC controller is electrically connected with the temperature control module, the data acquisition board, the internal-circulation temperature equalization device, the external-circulation temperature equalization device and the cooling module respectively; the temperature control module is electrically connected with the temperature sensor I and the temperature sensor II respectively; and the data acquisition board is electrically connected with the heat transfer coefficient sensor.

An on-line intelligent control method for the cooling characteristics of a quenching liquid in heat treatment production is carried out by using the quenching heat treatment device, wherein, step 1: firstly, a workpiece is preheated at a set temperature and maintained at the temperature, and the time is determined by the characteristics of the workpiece; and then the workpiece is heated to reach a set temperature and then maintained at the temperature, and the time is determined by the characteristics of the workpiece;

step 2: an aqueous quenching medium is selected, and a certain concentration of a quenching liquid is respectively filled in the quenching tank and the sub-tank and adjusted to have a proper temperature; and the cooling characteristics and the heat transfer coefficient of the quenching liquid used are measured by a cooling characteristic detector and a heat transfer coefficient detector, and compared with historical data in the industrial control computer so as to make appropriate corrections to the composition and temperature of the quenching liquid;

step 3: the workpiece is immersed into the quenching tank from a workpiece placement opening to start cooling; meanwhile the quenching liquid continues to be added by the external-circulation temperature equalization device between the quenching tank and the sub-tank; and the internal-circulation temperature equalization device in the quenching tank is started for temperature equalization such that the temperature of the quenching liquid is kept within a temperature rise range of 1 to 5 degrees, thereby inhibiting non-martensitic transformation in a high-temperature zone of the workpiece cooling process;

step 4: circulating agitators II arranged on diversion channels are closed after being started for a period of time; the external circulation between the quenching tank and the sub-tank is cut off; and then the internal circulation rate is changed to facilitate a polymer in the quenching liquid to be rapidly desolventized from the solution so as to form a polymer film on the surface of the workpiece, thereby achieving the lowest possible cooling rate in a low-temperature zone; and step 5: the workpiece is removed from the quenching tank after quenching.

The technical solution of the invention can effectively avoid the problem that the cooling of a workpiece in industrial production deviates from the ideal cooling characteristics of a quenching liquid obtained in a laboratory due to changes in the number and surface area of workpieces as well as changes in the composition and properties of a quenching liquid during its use. Such problem leads to the distortion and cracking of workpieces, especially workpieces with complex shapes or large workpieces made of medium/high carbon steel, alloy steel or non-ferrous metal. Accordingly, more desirable organization, performance and service life can be achieved.

DETAILED DESCRIPTION OF THE INVENTION

A preferred embodiment of the invention will be further described below with reference to the drawings.

Figure 1:
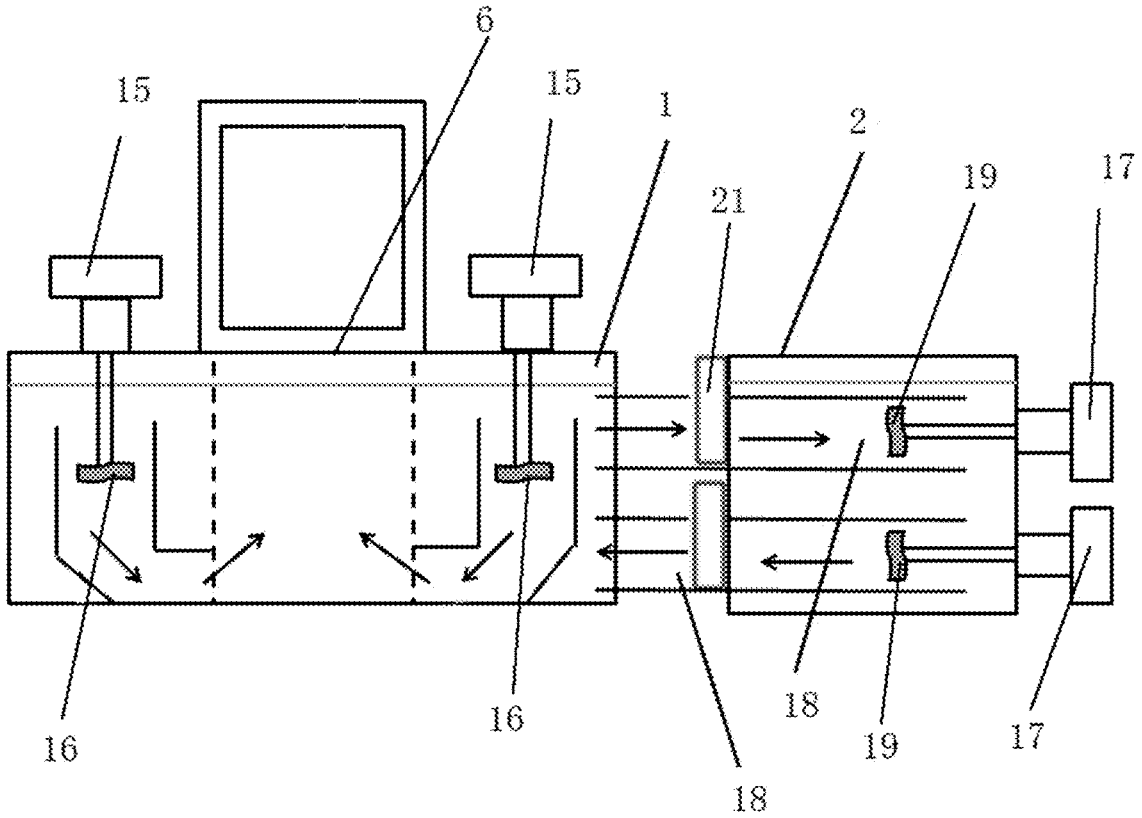
FIG. 1 is a schematic view of a circulating structure of a quenching heat treatment device.
Figure 2:
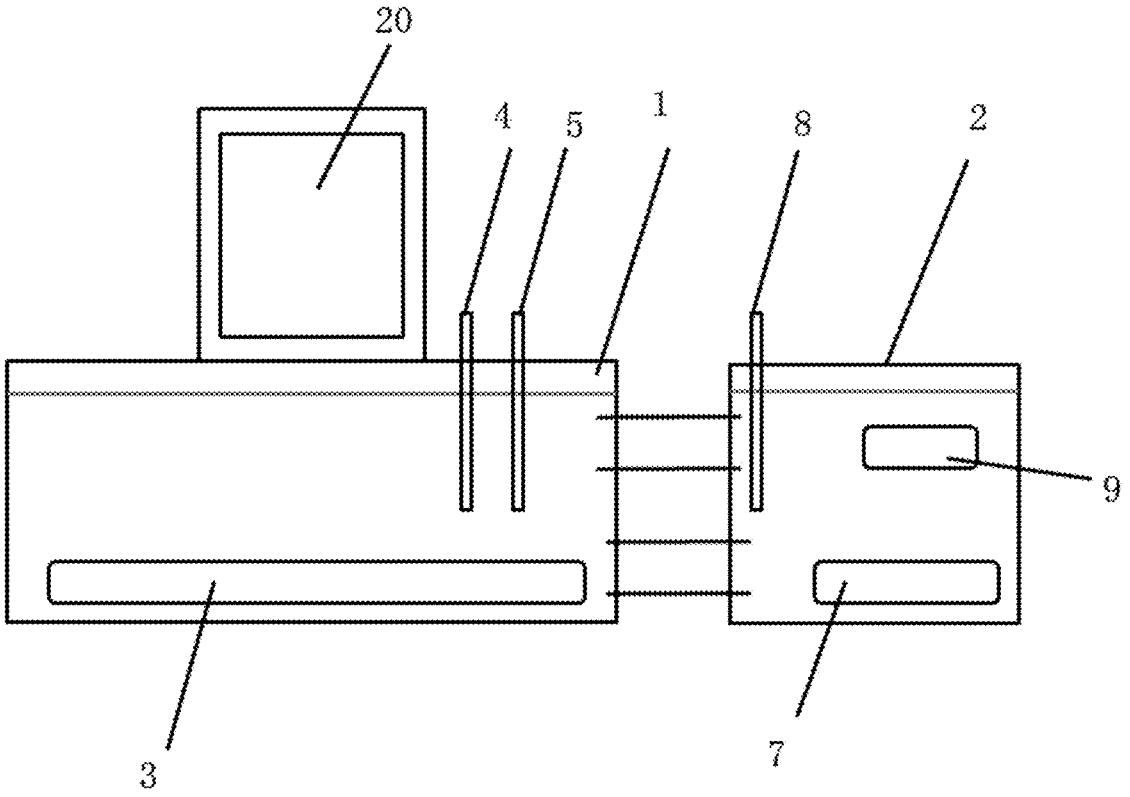
FIG. 2 is a schematic structural view of a monitoring and temperature regulation system of the quenching heat treatment device.
Figure 3:
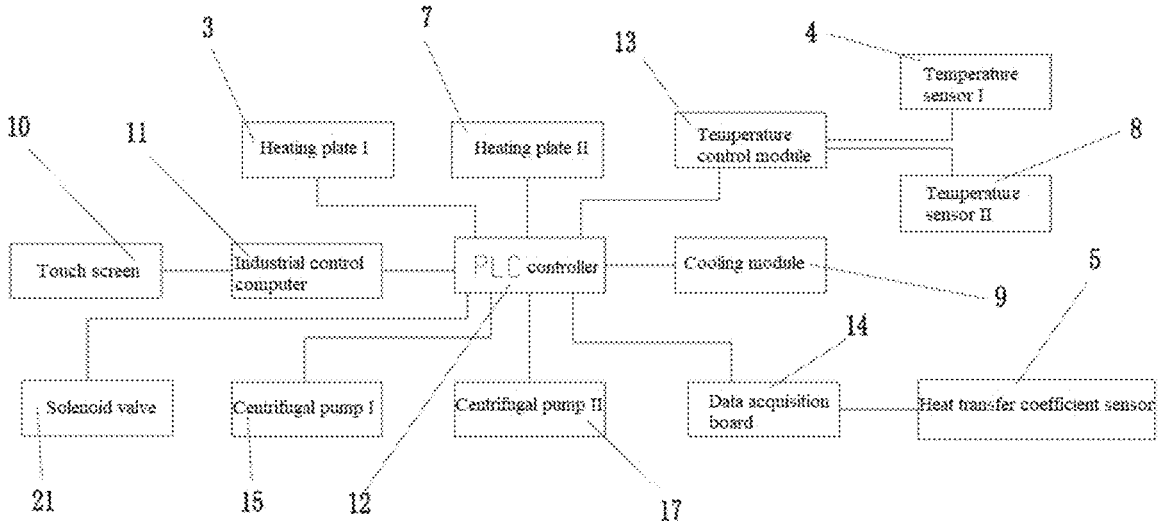
FIG. 3 is a control schematic diagram of the quenching heat treatment device.

As shown in FIGS. 1 to 3, a quenching heat treatment device comprises a quenching tank 1, a sub-tank 2 and a control cabinet.

A heating plate I 3 for heating a quenching agent is arranged at the bottom of the quenching tank; the quenching tank is internally provided with an internal-circulation temperature equalization device; a temperature sensor I 4 for measuring the temperature of the quenching agent and a heat transfer coefficient sensor 5 for measuring the heat transfer coefficient of the quenching agent are arranged at the top of the quenching tank; and a workpiece entrance 6 is arranged at the top of the quenching tank.

A heating plate II 7 for heating the quenching agent is arranged at the bottom of the sub-tank; an external-circulation temperature equalization device for equalizing the temperature of the quenching tank and the sub-tank are arranged between the sub-tank and the quenching tank; a temperature sensor II 8 for measuring the temperature of the quenching agent is arranged at the top of the sub-tank; and a cooling module 9 for cooling the quenching agent is arranged on a side wall of the sub-tank, and the cooling module 9 is an air-cooled evaporator or a water-cooled evaporator. The cooling module 9 is capable of rapidly adjusting the temperature of the quenching agent to a set temperature, thus enabling rapid cooling of the quenching agent.

The control cabinet is internally provided with a touch screen 10, an industrial control computer 11, a PLC controller 12, a temperature control module 13 and a data acquisition board 14; the industrial control computer is electrically connected with the touch screen and the PLC controller respectively via USB data lines; the PLC controller is electrically connected with the temperature control module, the data acquisition board, the internal-circulation temperature equalization device and the external-circulation temperature equalization device respectively; the temperature control module is electrically connected with the temperature sensor I and the temperature sensor II respectively; and the data acquisition board is electrically connected with the heat transfer coefficient sensor.

The internal-circulation temperature equalization device consists of several circulating agitators I 15; the circulating agitators I are respectively electrically connected with the PLC controller; the circulating agitators I are evenly arranged around a workpiece placement opening; it is preferred in this technical solution that two circulating agitators I are symmetrically arranged at both sides of the workpiece placement opening; and propellers I 16 are arranged at the bottom of the circulating agitators I.

The external-circulation temperature equalization device comprises two circulating agitators II 17, two diversion channels 18 and two solenoid valves; the diversion channels are arranged between the quenching tank and the sub-tank; the two solenoid valves are respectively arranged on the diversion channels to open or close the diversion channels; one of the diversion channels is positioned near the top of the quenching tank and the sub-tank, and the other diversion channel is positioned near the bottom of the quenching tank and the sub-tank; the two circulating agitators II respectively correspond to the two diversion channels; propellers II 19 are arranged at the bottom of the circulating agitators II; the propeller II of the circulating agitator II near the bottom of the sub-tank can push the quenching agent from the sub-tank into the quenching tank, and the propeller II of the circulating agitator II near the top of the sub-tank can draw the quenching agent from the quenching tank into the sub-tank;

and the two circulating agitators II and the two solenoid valves 21 are respectively electrically connected with the PLC controller.

A further improvement is that a wired network card and/or a wireless network card are/is configured in the industrial control computer. The wired or wireless network card can allow the data exchange between the industrial control computer and a mobile terminal device, and the connection between the industrial control computer and a remote control centerline, thus enabling remote control and monitoring of the quenching heat treatment device by management or maintenance personnel.

An on-line intelligent control method for the cooling characteristics of a quenching liquid in heat treatment production is carried out by using the quenching heat treatment device, wherein, step 1: firstly, a workpiece 20 is preheated at a set temperature and maintained at the temperature, and the time is determined by the characteristics of the workpiece; and then the workpiece is heated to reach a set temperature and then maintained at the temperature, and the time is determined by the characteristics of the workpiece;

step 2: an aqueous quenching medium is selected, and a quenching liquid having a concentration of 13% is respectively filled in the quenching tank and the sub-tank and adjusted to have a proper temperature; and the cooling characteristics and the heat transfer coefficient of the quenching liquid used are measured by a cooling characteristic detector and a heat transfer coefficient detector, and compared with historical data in the industrial control computer so as to make appropriate corrections to the composition and temperature of the quenching liquid;

step 3: the workpiece is immersed into the quenching tank from the workpiece placement opening to start cooling; meanwhile the quenching liquid continues to be added by the external-circulation temperature equalization device between the quenching tank and the sub-tank; and the internal-circulation temperature equalization device in the quenching tank is started for temperature equalization such that the temperature of the quenching liquid is kept within a temperature rise range of 1 to 5 degrees, thereby inhibiting non-martensitic transformation in a high-temperature zone of the workpiece cooling process;

step 4: the solenoid valves 21 arranged on the diversion channels are closed after being started for 10 s; the external circulation between the quenching tank and the sub-tank is cut off; and then the internal circulation rate is changed to facilitate a polymer in the quenching liquid to be rapidly desolventized from the solution so as to form a polymer film on the surface of the workpiece, thereby achieving the lowest possible cooling rate in a low-temperature zone; and step 5: the workpiece is removed from the quenching tank after quenching.

In order to better describe the technical solution of the present application, the method of the patent is used to solve the problem that a medium-carbon alloy steel workpiece is prone to insufficient hardness by oil quenching and easily deformed and cracked by water quenching when its effective thickness is greater than 100 mm, wherein the specific steps are as follows:

1. the workpiece is preheated at 600° C. and maintained at the temperature for 1 h, and then heated to 845° C. and maintained at the temperature for 4 h;

2. a Houghton series PAG aqueous quenching medium is selected, a quenching liquid having a concentration of 13% is respectively filled in the quenching tank and the sub-tank and adjusted to have a temperature of 30° C., the cooling characteristics and the heat transfer coefficient of the formulated quenching medium are detected by the cooling characteristic detector and the heat transfer coefficient sensor, and the concentration and temperature are appropriately corrected by the industrial control computer;

3. the workpiece is immersed into the quenching tank to start cooling, the external circulation between the quenching tank and the sub-tank is started for temperature control, and the internal circulation in the quenching tank is started for temperature equalization such that the temperature of the quenching liquid is kept within a temperature rise range of 1 to 5 degrees;

4. the external circulation between the quenching tank and the sub-tank is closed after about 10 s, the internal circulation rate is changed to facilitate the PAG polymer in the quenching liquid to be rapidly desolventized from the solution so as to form a polymer film on the surface of the workpiece, and the cooling rate of the workpiece is adjusted; and 5. the workpiece is removed from the quenching tank after quenching.

A detailed description has been made on a preferred embodiment of the patent using a PAG water-based quenching liquid and a medium-carbon alloy steel workpiece.

The above embodiments are only for the purpose of describing the technical concept and features of the invention, and aim at enabling the persons skilled in the art to understand and implement the contents of the invention, and therefore cannot limit the protection scope of the invention. Any equivalent change or modification made based on the spirit and essence of the invention shall be covered within the protection scope of the invention.

The invention claimed is:

1. A quenching heat treatment device, comprising:

a quenching tank;

a sub-tank;

a control cabinet;

a heating plate I for heating a quenching agent being arranged at a bottom of the quenching tank; the quenching tank being internally provided with an internal-circulation temperature equalization device;

a temperature sensor I for measuring a temperature of the quenching agent and a heat transfer coefficient sensor for measuring a heat transfer coefficient of the quenching agent being arranged at a top of the quenching tank; and a workpiece entrance being arranged at the top of the quenching tank;

two diversion channels arranged between the quenching tank and the sub-tank configured to pass the quenching agent from the quenching tank to the sub-tank;

a heating plate II for heating the quenching agent being arranged at a bottom of the sub-tank;

an external-circulation temperature equalization device for equalizing a temperature of the quenching agent in the quenching tank and the sub-tank being arranged between the sub-tank and the quenching tank;

a temperature sensor II for measuring a temperature of the quenching agent being arranged at a top of the sub-tank; and a cooling module for cooling the quenching agent being arranged on a side wall of the sub-tank, wherein the control cabinet is internally provided with a touch screen, an industrial control computer, a PLC controller, a temperature control module and a data acquisition board; the industrial control computer being electrically connected with the touch screen and the PLC controller respectively via USB data lines; the PLC controller is electrically connected with the temperature control module, the data acquisition board, the internal-circulation temperature equalization device, the external-circulation temperature equalization device and the cooling module respectively; the temperature control module is electrically connected with the temperature sensor I and the temperature sensor II respectively; and the data acquisition board is electrically connected with the heat transfer coefficient sensor.

2. The quenching heat treatment device according to claim 1, wherein the internal-circulation temperature equalization device consists of several circulating agitators I; the circulating agitators I are respectively electrically connected with the PLC controller; the circulating agitators I are evenly arranged around a workpiece placement opening; and a propeller I is attached to a bottom of each circulating agitator I.

3. The quenching heat treatment device according to claim 1, wherein the external-circulation temperature equalization device comprises two circulating agitators II, two solenoid valves; the two solenoid valves are respectively arranged on the diversion channels to open or close the diversion channels; one of the diversion channels is positioned near the top of the quenching tank and the sub-tank, and the other diversion channel is positioned near the bottom of the quenching tank and the sub-tank; the two circulating agitators II respectively correspond to the two diversion channels; a propeller II is attached to a bottom of each circulating agitator II; the propeller II of the circulating agitator II near the bottom of the sub-tank can push the quenching agent from the sub-tank into the quenching tank, and the propeller II of the circulating agitator II near the top of the sub-tank can draw the quenching agent from the quenching tank into the sub-tank; and the two circulating agitators II and the two solenoid valves are respectively electrically connected with the PLC controller.

4. The quenching heat treatment device according to claim 1, wherein a wired network card and/or a wireless network card are/is configured in the industrial control computer.

5. A control method for cooling characteristics of a quenching liquid in heat treatment production, being carried out by using the quenching heat treatment device according to claim 1, wherein, step 1: firstly, the workpiece is preheated at a set temperature and maintained at the set temperature, and a time is determined by the characteristics of the workpiece; and then the workpiece is heated to reach a set temperature and then maintained at the set temperature, and a time is determined by the characteristics of the workpiece;

step 2: a water-soluble polymer quenching medium is selected, and a certain concentration of a quenching liquid is respectively filled in the quenching tank and the sub-tank and adjusted to have a proper temperature; and the cooling characteristics and the heat transfer coefficient of the quenching liquid used are measured by a cooling characteristic detector and a heat transfer coefficient detector, and compared with historical data in the industrial control computer so as to make appropriate corrections to a composition and temperature of the quenching liquid;

step 3: the workpiece is immersed into the quenching tank from a workpiece placement opening to start cooling; meanwhile the quenching liquid continues to be added by the external-circulation temperature equalization device between the quenching tank and the sub-tank; and the internal-circulation temperature equalization device in the quenching tank is started for temperature equalization such that the temperature of the quenching liquid is kept within a temperature rise range of 1 to 5 degrees, thereby inhibiting non-martensitic transformation in a high-temperature zone of a workpiece cooling process;

step 4: the circulating agitators II arranged on the diversion channels are closed after being started for a period of time; the external circulation between the quenching tank and the sub-tank is cut off; and then the internal circulation rate is changed to facilitate the polymer in the quenching liquid to be rapidly desolventized from the solution so as to form a polymer film on the surface of the workpiece, thereby achieving a lowest possible cooling rate in a low-temperature zone; and step 5: the workpiece is removed from the quenching tank after quenching.

6. The control method for the cooling characteristics of a quenching liquid in heat treatment production according to claim 5, wherein the starting time in the step 4 is 8-15 s, and then the circulating agitators II are closed.

* * * * *